US011776719B2

(12) United States Patent
Chen et al.

(10) Patent No.: US 11,776,719 B2
(45) Date of Patent: Oct. 3, 2023

(54) METHOD FOR PREPARING SINTERED NDFEB MAGNETS

(71) Applicant: Yantai Dongxing Magnetic Materials Inc., Shandong (CN)

(72) Inventors: Xiulei Chen, Shandong (CN); Zhongjie Peng, Shandong (CN); Xiaonan Zhu, Shandong (CN); Zhanji Dong, Shandong (CN); Kaihong Ding, Shandong (CN)

(73) Assignee: Yantai Dongxing Magnetic Materials Inc., Shandong (CN)

( * ) Notice: Subject to any disclaimer, the term of this patent is extended or adjusted under 35 U.S.C. 154(b) by 0 days.

(21) Appl. No.: 17/531,809

(22) Filed: Nov. 22, 2021

(65) Prior Publication Data

US 2022/0165461 A1 May 26, 2022

(30) Foreign Application Priority Data

Nov. 20, 2020 (CN) ..... 202011313137.4

(51) Int. Cl.
*H01F 1/057* (2006.01)
*H01F 7/02* (2006.01)

(52) U.S. Cl.
CPC ..... *H01F 1/0577* (2013.01); *H01F 1/0576* (2013.01); *H01F 7/02* (2013.01)

(58) Field of Classification Search
None
See application file for complete search history.

(56) References Cited

FOREIGN PATENT DOCUMENTS

| | | | | |
|---|---|---|---|---|
| CN | 103123843 A | | 5/2013 | |
| CN | 105469973 A | * | 4/2016 | ..... H01F 1/053 |
| JP | 2017188524 A | * | 10/2017 | |

OTHER PUBLICATIONS

Machine translation of JP 2017-188524A. (Year: 2017).*
Machine translation of CN 105469973A. (Year: 2016).*
Machine translation of CN103123843A. (Year: 2013).*

* cited by examiner

*Primary Examiner* — Xiaowei Su
(74) *Attorney, Agent, or Firm* — Gang Yu

(57) ABSTRACT

The present disclosure refers to a method for preparing sintered NdFeB magnets, including:

a) Preparing alloy flakes from a raw material by strip casting, performing a hydrogen decrepitation to produce alloy pieces, pulverization the alloy pieces to an alloy powder, performing molding and orientation, cold isostatic pressing, and getting a green compact;

b) Putting the green compact into a vacuum furnace and performing a first sintering step in 830 to 880° C. for 2 to 10 hours and $5\times10^{-1}$ Pa or less;

c) Performing a second sintering step while applying a pressure to the green compact achieved by step b), the pressure is 1 MPa to 5 MPa and the sintering temperature is 720 to 850° C. for 15 to 60 minutes, and the temperature of the first sintering step is at least 10° C. higher than that of the second sintering step;

d) Subjecting the sintered magnet of step c) to an annealing treatment.

2 Claims, 3 Drawing Sheets

METHOD FOR PREPARING SINTERED NDFEB MAGNETS

BACKGROUND OF THE DISCLOSURE

Field of the Disclosure

The present disclosure relates to a method for preparing magnetic materials, in particular for preparing sintered NdFeB magnets.

Description of the Prior Art

NdFeB magnets are widely used in storage devices, electronic components, wind power generation, motors and other fields due to their excellent magnetic properties. With the expansion of application fields, neodymium iron boron magnets used under severe conditions need to further improve their magnetic properties in order to meet their magnetic performance requirements.

At present, the remanence of NdFeB products can reach about 90% of the theoretical saturation magnetization of $Nd_2Fe_{14}B$, but the coercivity is still difficult to reach one third of the theoretical value without addition of heavy rare earth elements. Substitution of heavy rare earth elements can significantly improve coercivity of neodymium iron boron magnets. However, heavy rare earths are expensive and have fewer resources. In order to reduce the cost of raw materials and reduce the usage of heavy rare earth, optimizing the manufacturing process should be taken into consideration.

Magnets prepared by traditional processes often have defects such as low density and high porosity, and uneven distribution of grain boundary phase. In order to improve the microstructure, the method of applying pressure during the sintering process has been widely used. Patent number CN103981337A performs three-steps heat treatment on the sintered magnet, and applies a pressure of 20 MPa to 60 MPa in the second-step heat treatment to improve the performance of the magnet. Patent CN103310933B presents a method of implying pressure along four directions while sintering. The neodymium-rich phase can become liquid at high temperature which can lead to liquid phase sintering. The magnet prepared by this method has good shrinkage characteristics and the internal pores are reduced. Patent CN109791836A implies pressure when the sintering temperature reaches 300° C. or higher, followed by high and low temperature heat treatment, which can not only suppress the uneven shrinkage caused by sintering, but also suppress the uneven structure and magnetic properties of the magnet caused by sintering with pressure.

However, in some present methods, the pressure should be kept during the whole sintering process, which requires special tooling and molds. It increases the cost and difficulty of the equipment. And also the magnets are easy to be overheated under high temperature and high pressure, which can result in performance degradation. Especially for high rare earth content magnets, it is densification is not easy during the sintering process. At the same time, the rare earth-rich phase is easy to be enriched in the triangle area, and it is not easy to distribute between the two main phase particles to form an effective grain boundary phase, which limits the improvement of magnetic properties.

SUMMARY OF THE DISCLOSURE

The present disclosure provides a preparation method for a sintered type NdFeB permanent magnet as defined in claim 1. The method includes the steps of:

a) Preparing alloy flakes from a raw material of the NdFeB magnet by strip casting, then performing a hydrogen decrepitation of the alloy flakes to produce alloy pieces, then pulverization the alloy pieces to an alloy powder by jet mill, and performing molding and orientation, cold isostatic pressing, and then get a green compact;

b) Putting the green compact into a vacuum furnace and performing a first sintering step, wherein the sintering temperature is in the range of 830° C. to 880° C. for 2 to 10 hours and the pressure in the furnace is $5\times10^{-1}$ Pa or less;

c) Performing a second sintering step while applying a pressure along the magnetic orientation direction of the green compact achieved by step b), wherein the pressure applied on the green compact is in the range of 1 MPa to 5 MPa and the sintering temperature is in the range of 720° C. to 850° C. for 15 to 60 minutes, and wherein the temperature of the first sintering step is at least 10° C. higher than the temperature of the second sintering step; and d) Subjecting the sintered magnet of step c) to an annealing treatment.

In step a), a mass percentage of rare earth elements may be in the range of 33.0% to 37.0% in the alloy flakes.

In step of b), a density of the green compact may be in the range of 7.08 to 7.37 g/cm$^3$ after the first sintering step.

Thus, for NdFeB magnets with high rare earth content, the green compact may be firstly sintered to a certain density at a temperature lower than the traditional sintering temperature. In a second sintering step, the magnet is sintered at a lower temperature while applying a pressure. By this method, the problem of abnormal grain growth caused by high sintering temperature can be avoided, and the magnet can also be more densified. At the same time, it also contributes to the formation of the grain boundary phase between the main phase particles.

A main aspect of the present disclosure is the two-step sintering process. The first step is sintering at lower temperature without pressure applied. During the second sintering step, pressure is applied in order to obtain sufficient sintering driving force, which can significantly improve sintering efficiency and promote densification. Because the density is in a suitable range after the first step of low-temperature sintering, so that under the pressure and heating conditions of the second step of sintering, the neodymium-rich component located in the triangle region will diffuse along the grain boundary. Finally, there is a uniform non-ferromagnetic phase existing in the grain boundary location. The coercivity is improved by the better suppression of magnetic exchange coupling. The method of the present disclosure only applies a small pressure for a short time in the key steps, which can achieve obvious effects and has a higher cost performance. The pressure applied in the second sintering step is much smaller than the pressure in a conventional hot-pressing magnet method, and the mechanisms are completely different. The problem of a dis-uniform microstructure, which occurs in the hot-pressing method, can be avoided.

Further embodiments of the disclosure could be learned from the dependent claims and following description.

DETAILED DESCRIPTION

Figure 1:
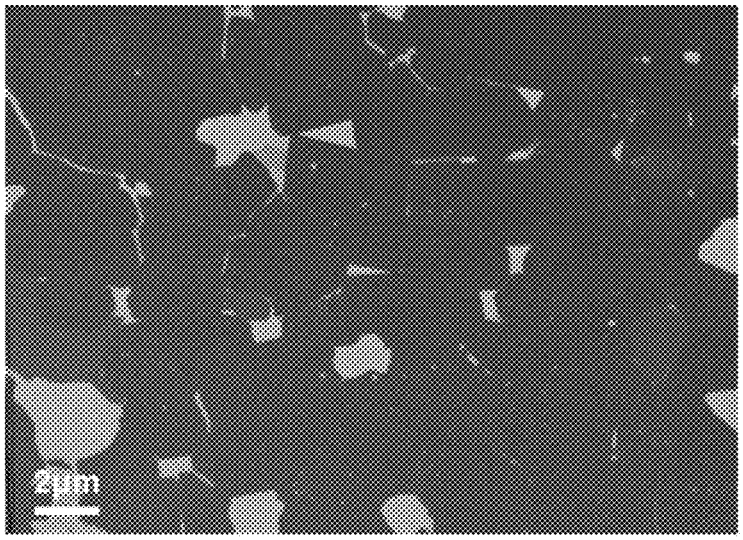
FIG. 1 is a backscattered electron (BSE) image from a scanning electron microscopes (SEM) of implementing example 1.
Figure 2:
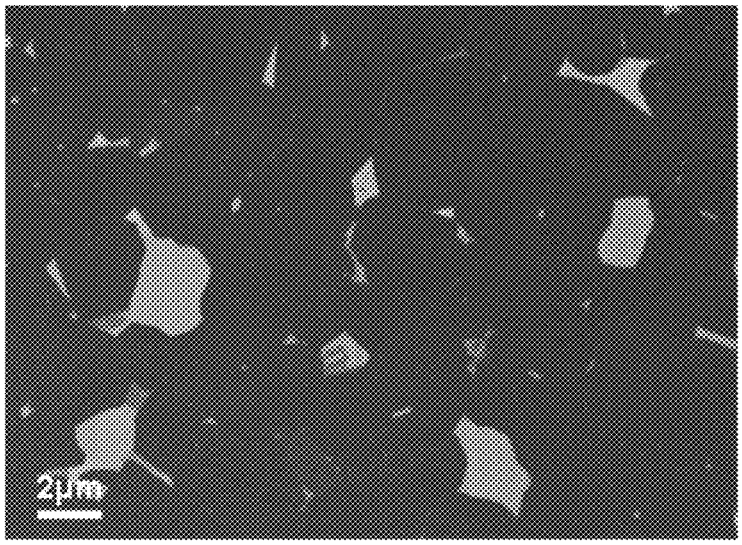
FIG. 2 is a BSE image of implementing example 2.
Figure 3:
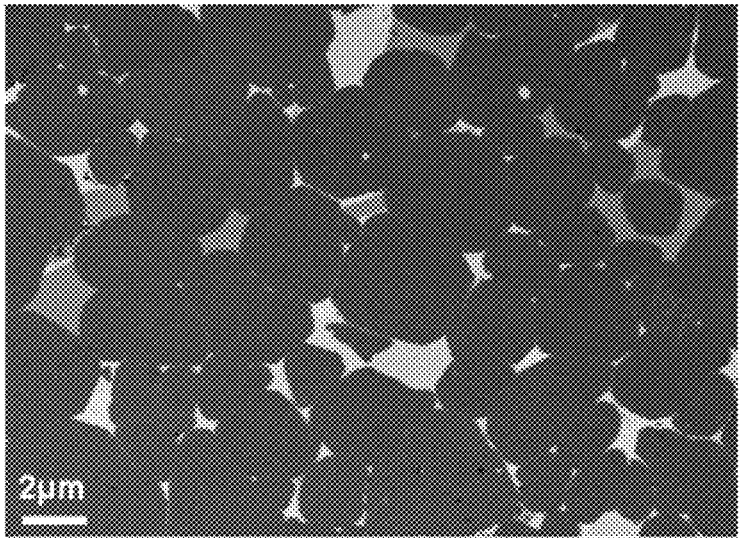
FIG. 3 is a BSE image of implementing example 3.
Figure 4:
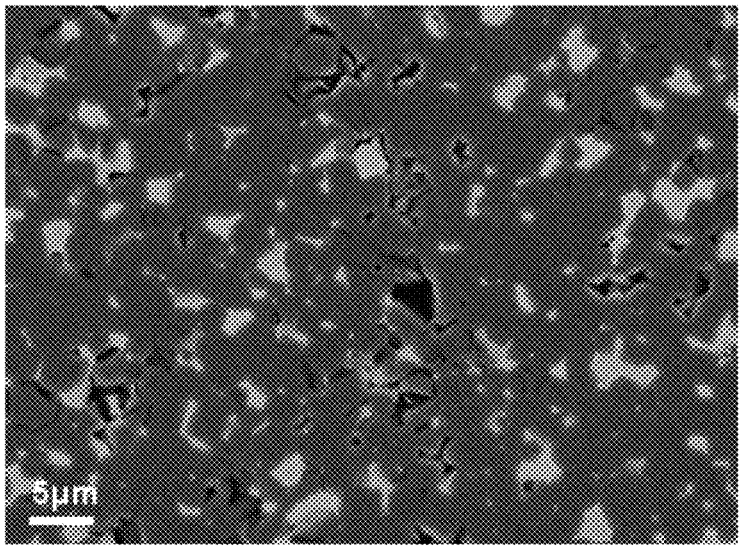
FIG. 4 is a BSE image of comparative example 1.

Reference will now be made in detail to embodiments. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art.

A NdFeB magnet (also known as MB or Neo magnet) is the most widely used type of rare-earth magnet. It is a permanent magnet made from an alloy of neodymium, iron, and boron to form the $Nd_2Fe_{14}B$ tetragonal crystalline structure as a main phase. Besides, the microstructure of Nd—Fe—B magnets includes usually a Nd-rich phase. The alloy may include further elements in addition to or partly substituting neodymium and iron.

The composition of the NdFeB powder may refer to the commercially available general-purpose sintered NdFeB grades. For example, its basic composition can be set to $RE_aT_{(1-abc)}B_bM_c$, where RE is a rare earth element selected from at least one of Pr, Nd, Dy, Tb, Ho, and Gd, T is at least one of Fe or Co, B is element B, M is at least one of Al, Cu, Ga, Ti, Zr, Nb, Mo, and V, and a, b, and c may be 33 wt. %≤a≤wt. 37%, 0.85 wt. %≤b−1.3 wt. %, and c≤5 wt. %.

Commercially available or freshly produced alloy powders could be used for the inventive process of preparing the NdFeB powders, respectively sintered NdFeB magnets. Specifically, NdFeB alloy flakes may be produced by a strip casting process, then subjected to a hydrogen embrittlement process and jet milling for preparing the desired NdFeB magnet powders, which are modified by depositing a mixed metal coating. The strip casting process, the hydrogen embrittlement process, and the jet milling process are currently well-known technologies. Cold isostatic pressing of the alloy powder to a green compact while applying a magnetic field for orientation is also state of the art. In other words, preparation and composition of the NdFeB alloy flakes and the process up to the preparing of a green compact is well-known in the art.

The method of preparing sintered NdFeB magnet includes the steps of:

step a): Preparing alloy flakes from a raw material of the NdFeB magnet by strip casting, then performing a hydrogen decrepitation of the alloy flakes to produce alloy pieces, then pulverization the alloy pieces to an alloy powder by jet mill, and finally performing molding and orientation, cold isostatic pressing, and then get a green compact.

In other words, the raw materials are made into alloy flakes by strip casting method, and then hydrogen absorption and dehydrogenation are performed followed by milling powders by a jet mill process. Then the powder is molded and orientated, and being performed by cold isostatic pressing to get green compact.

In step a), a mass percentage of rare earth elements may be in the range of 33.0% to 37.0% in the alloy flakes.

step b): Putting the green compact into a vacuum furnace and performing a first sintering step, wherein the sintering temperature is in the range of 830° C. to 880° C. for 2 to 10 hours and the pressure in the furnace is $5\times10^{-1}$ Pa or less.

In other words, the green compact is put into a vacuum furnace for a first-step sintering. The sintering temperature is 830° C. to 880° C. with a duration time of 2 to 10 hours. Vacuum of the furnace is under $5\times10^{-1}$ Pa.

In step of b), a density of the green compact may be in the range of 7.08 to 7.37 g/cm$^3$ after the first sintering step.

step c): Performing a second sintering step while applying a pressure along the magnetic orientation direction of the green compact achieved by step b), wherein the pressure applied on the green compact is in the range of 1 MPa to 5 MPa and the sintering temperature is in the range of 720° C. to 850° C. for 15 to 60 minutes, and wherein the temperature of the first sintering step is at least 10° C. higher than the temperature of the second sintering step.

In other words, the magnet finished after the first-step sintering is performed a second-step sintering while applying a pressure on the magnet along the orientation direction. The sintering temperature is 720° C. to 850° C. with a duration time of 15 to 60 minutes. The pressure applied on the magnet is 1 MPa to 5 MPa. This step is finished under a vacuum atmosphere. The temperature in the first-step sintering is at least 10° C. higher than it in the second-step sintering.

step d): Subjecting the sintered magnet of step c) to an annealing treatment.

To have a better understanding of the present disclosure, the examples set forth below provide illustrations of the present disclosure. The examples are only used to illustrate the present disclosure and do not limit the scope of the present disclosure.

In order to exhibit the performance, the density of the magnet was separately tested after each sintering step. The magnetic properties of the final magnet were also determined. Backscattered electron (BSE) image of the magnet was taken by scanning electron microscope.

IMPLEMENTING EXAMPLE 1

A raw material including Pr—Nd (35.0 wt. %), B (0.95 wt. %), Co (1.0 wt. %), Al (0.55 wt. %), Cu (0.10 wt. %), Ga (0.40 wt. %), Ti (0.10 wt. %), and Fe as a balance, and unavoidable impurities is made into alloy flakes by a strip casting process. The alloy flakes are put into a hydrogen treatment furnace for normal hydrogen absorption and dehydrogenation. Then after milling powders by jet mill, molding and orientation, and cold isostatic pressing, a green compact was obtained. The green compact was put into vacuum furnace for the first-step sintering, the vacuum value is under $5\times10^{-1}$ Pa. The sintering temperature is 830° C. for a duration time of 10 hours and then cooled down to room temperature. The magnet obtained by the first-step sintering is then subjected a second-step sintering at a temperature of 820° C. and at the same time a pressure of 1 MPa is applied on the magnet along the orientation direction under a vacuum condition. The duration time of sintering and pressing is 30 minutes, after which the magnet is cooled to room temperature. Then the magnet is heated to 500° C. for a duration time of 2 hours for the annealing treatment.

IMPLEMENTING EXAMPLE 2

A raw material including Pr—Nd (33.0 wt. %), B (0.95 wt. %), Co (1.0 wt. %), Al (0.55 wt. %), Cu (0.10 wt. %), Ga (0.40 wt. %), Ti (0.10 wt. %), and Fe as a balance, and unavoidable impurities is made into alloy flakes by a strip casting process. The alloy flakes are put into a hydrogen treatment furnace for normal hydrogen absorption and dehydrogenation. Then after milling powders by jet mill, molding and orientation, and cold isostatic pressing, a green compact was obtained. The green compact was put into vacuum furnace for the first-step sintering, the vacuum value is under $5\times10^{-1}$ Pa. The sintering temperature is 880° C. for a duration time 2 hours and then cooled down to room temperature. The magnet obtained by the first-step sintering is then subjected a second-step sintering at a temperature of 720° C. and at the same time a pressure of 5 MPa is applied on the magnet along the orientation direction under a vacuum condition. The duration time of sintering and pressing is 60 minutes, after which the magnet is cooled to room temperature. Then the magnet is heated to 500° C. for a duration time of 2 hours for the annealing treatment.

IMPLEMENTING EXAMPLE 3

A raw material including Pr—Nd (37.0 wt. %), B (0.95 wt. %), Co (1.0 wt. %), Al (0.55 wt. %), Cu (0.10 wt. %), Ga (0.40 wt. %), Ti (0.10 wt. %), and Fe being present as a balance, and unavoidable impurities is made into alloy flakes by a strip casting process. The alloy flakes are put into a hydrogen treatment furnace for normal hydrogen absorption and dehydrogenation. Then after milling powders by jet mill, molding and orientation, and cold isostatic pressing, a green compact was obtained. The green compact was put into vacuum furnace for the first-step sintering, the vacuum value is under $5\times10^{-1}$ Pa. The sintering temperature is 865° C. for a duration time 6 hours and then cooled down to room temperature. The magnet obtained by the first-step sintering is then subjected a second-step sintering with the temperature 850° C. and at the same time a pressure of 3 MPa is applied on the magnet along the orientation direction under a vacuum condition. The duration time of sintering and pressing is 15 minutes, after which the magnet is cooled to room temperature. Then the magnet is heated to 500° C. for a duration time of 2 hours for the annealing treatment.

COMPARATIVE EXAMPLE 1

A raw material including Pr—Nd (35.0 wt. %), B (0.95 wt. %), Co (1.0 wt. %), Al (0.55 wt. %), Cu (0.10 wt. %), Ga (0.40 wt. %), Ti (0.10 wt. %), and Fe being present as a balance, and unavoidable impurities is made into alloy flakes by a strip casting process. The alloy flakes are put into a hydrogen treatment furnace for normal hydrogen absorption and dehydrogenation. Then after milling powders by jet mill, molding and orientation, and cold isostatic pressing, a green compact was obtained. The green compact was put into vacuum furnace for sintering, the vacuum value is under $5\times10^{-1}$ Pa. Sintering temperature is 830° C. with a duration time of 10 hours. After cooled to room temperature the magnet is reheated to 500° C. for a duration time of 2 hours for the annealing treatment.

COMPARATIVE EXAMPLE 2

A raw material including Pr—Nd (35.0 wt. %), B (0.95 wt. %), Co (1.0 wt. %), Al (0.55 wt. %), Cu (0.10 wt. %), Ga (0.40 wt. %), Ti (0.10 wt. %), and Fe being present as a balance, and unavoidable impurities is made into alloy flakes by a strip casting process. The alloy flakes are put into a hydrogen treatment furnace for normal hydrogen absorption and dehydrogenation. Then after milling by jet mill, molding and orientation, and cold isostatic pressing, a green compact was obtained. The green compact was put into vacuum furnace for sintering, the vacuum value is under $5\times10^{-1}$ Pa. Sintering temperature is 930° C. with a duration time of 2 hours. After cooled to room temperature the magnet is reheated to 500° C. for a duration time of 2 hours for the annealing treatment.

COMPARATIVE EXAMPLE 3

A raw material including Pr—Nd (35.0 wt. %), B (0.95 wt. %), Co (1.0 wt. %), Al (0.55 wt. %), Cu (0.10 wt. %), Ga (0.40 wt. %), Ti (0.10 wt. %), and Fe being present as a balance, and unavoidable impurities is made into alloy flakes by a strip casting process. The alloy flakes are put into a hydrogen treatment furnace for normal hydrogen absorption and dehydrogenation. Then after milling powders by jet mill, molding and orientation, and cold isostatic pressing, a green compact was obtained. The green compact was put into vacuum furnace for the first-step sintering, the vacuum value is under $5\times10^{-1}$ Pa. The sintering temperature is 830° C. for a duration time 10 hours and then cool to room temperature. The magnet obtained by the first-step sintering is then subjected a second-step sintering with the temperature 700° C. and at the same time a pressure of 0.5 MPa is applied on the magnet along the orientation direction under a vacuum condition. The duration time of sintering and pressing is 30 minutes, after which the magnet is cooled to room temperature. Then the magnet is heated to 500° C. for a duration time of 2 hours for the annealing treatment.

Process parameters of implementing examples and comparative examples are listed in table 1.

TABLE 1

Process parameters of the examples

| | Content of rare earth | Conditions of first-step sintering | | Conditions of second-step sintering | | |
|---|---|---|---|---|---|---|
| | Pr—Nd (wt. %) | Temp. (° C.) | time (hours) | Temp. (° C.) | time (minutes) | pressure (MPa) |
| Implementing example 1 | 35.0 | 830 | 10 | 820 | 30 | 1.0 |
| Implementing example 2 | 33.0 | 880 | 2 | 720 | 60 | 5.0 |
| Implementing example 3 | 37.0 | 865 | 6 | 850 | 15 | 3.0 |
| Comparative example 1 | 35.0 | 830 | 10 | — | — | — |
| Comparative example 2 | 35.0 | 930 | 2 | — | — | — |
| Comparative example 3 | 35.0 | 830 | 10 | 700 | 30 | 0.5 |

Density and magnetic properties of magnets in implementing and comparative examples are listed in table 2.

TABLE 2

Density and magnetic properties of magnets

| | Magnetic properties | | density (g/cm$^3$) | |
|---|---|---|---|---|
| | Br (T) | Hcj (kA/m) | after first-step sintering | after second-step sintering |
| Implementing example 1 | 1.250 | 1711 | 7.28 | 7.43 |
| Implementing example 2 | 1.305 | 1640 | 7.08 | 7.46 |

TABLE 2-continued

| Density and magnetic properties of magnets | | | | |
|---|---|---|---|---|
| | Magnetic properties | | density ($g/cm^3$) | |
| | Br (T) | Hcj (kA/m) | after first-step sintering | after second-step sintering |
| Implementing example 3 | 1.213 | 1783 | 7.37 | 7.43 |
| Comparative example 1 | 1.226 | 1489 | 7.28 | — |
| Comparative example 2 | 1.241 | 1656 | 7.41 | — |
| Comparative example 3 | 1.236 | 1616 | 7.28 | 7.37 |

It can be seen from the test results of implementing examples 1, 2, and 3 that using the method of the present disclosure, the density of the magnet after the first step of sintering is low. And after the second step sintering with pressure at lower temperature, the density of the magnet can be significantly improved to 7.43 $g/cm^3$ or higher. It also enables the magnet to have a higher remanence.

Figure 5:
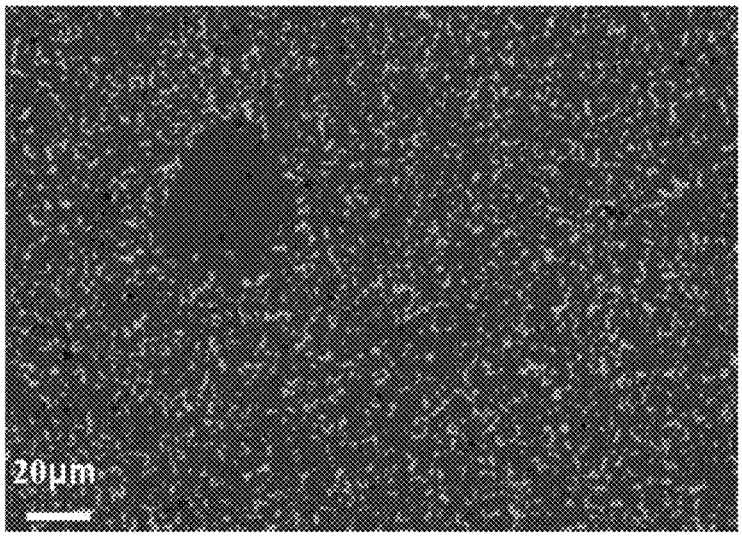
FIG. 5 is a BSE image of comparative example 2.
Figure 6:
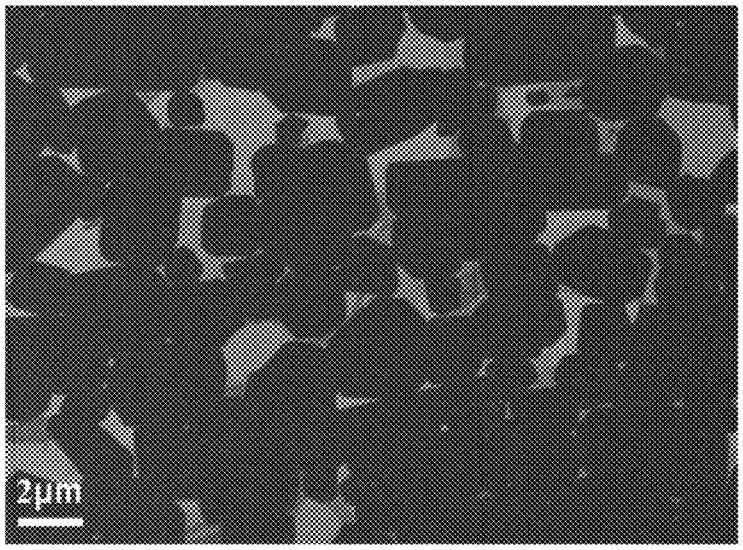
FIG. 6 is a BSE image of comparative example 3.

Microstructure of the magnets in implementing examples seems more densified than magnets in comparative examples according to the BSE images. And also there are more uniform grain boundary phase, which makes the magnets have higher coercivity. In comparative example 1, only the first step of sintering was carried out. The density of the magnet was low and seems less densified which makes both remanence and coercivity lower. Magnet in comparative example 2 was sintered by the traditional process at 930° C. It is easy to lead abnormal grain growth, which can be seen from FIG. 5 due to high amount of rare earth in the composition. The two-step sintering process proposed was also used in comparative example 3, but the pressure and temperature in the second sintering process were lower than the requirements of the present disclosure, resulting in a low magnet density after the second sintering process. It can be seen from FIG. 6 that the grain boundary phase distributes not as uniform as it in magnet of the implementing examples. This is one of the main reasons of poor coercivity in the comparative examples.

In summary, using the method of the present can significantly improve microstructure and magnetic properties of the NdFeB sintered magnet.

What is claimed is:

1. A method for preparing sintered NdFeB magnets, the method including the steps of:

a) Preparing alloy flakes from a raw material of the NdFeB magnet by strip casting, then performing a hydrogen decrepitation of the alloy flakes to produce alloy pieces, then pulverization the alloy pieces to an alloy powder by jet mill, and finally performing molding and orientation, cold isostatic pressing, and then get a green compact;

b) Putting the green compact into a vacuum furnace and performing a first sintering step, wherein the sintering temperature is in the range of 830° C. to 880° C. for 2 to 10 hours and the pressure in the furnace is $5\times10^{-1}$ Pa or less, and a density of the green compact being in the range of 7.08 to 7.37 $g/cm^3$ after the first sintering step;

c) Performing a second sintering step while applying a pressure along the magnetic orientation direction of the green compact achieved by step b), wherein the pressure applied on the green compact is in the range of 1 MPa to 5 MPa and the sintering temperature is in the range of 720° C. to 850° C. for 15 to 60 minutes, and wherein the temperature of the first sintering step is at least 10° C. higher than the temperature of the second sintering step; and d) Subjecting the sintered magnet of step c) to an annealing treatment.

2. The method of claim 1, wherein in step a) a mass percentage of rare earth elements is in the range of 33.0% to 37.0% in the alloy flakes.

* * * * *